United States Patent [19]

Morgan

[11] Patent Number: 4,941,492

[45] Date of Patent: Jul. 17, 1990

[54] RAZOR BLADE RINSING DEVICE

[76] Inventor: Dale D. Morgan, 28168 Lorraine, Warren, Mich. 48093

[21] Appl. No.: 353,544

[22] Filed: May 18, 1989

[51] Int. Cl.[5] ..... B08B 3/02

[52] U.S. Cl. ..... 134/182; 30/41; 239/499; 239/590.3

[58] Field of Search ..... 134/115 R, 182, 183, 134/198; 4/256; 239/499, 553.3, 590.3; 30/41, 123.3

[56] References Cited

U.S. PATENT DOCUMENTS

| | | | |
|---|---|---|---|
| 2,430,739 | 11/1947 | Scott | 4/256 |
| 2,858,120 | 10/1958 | Goodrie | 239/590.3 X |
| 2,990,123 | 6/1961 | Hyde | 239/499 X |
| 3,831,860 | 8/1974 | Gullaksen et al. | 239/553.3 X |
| 4,027,387 | 6/1977 | Kellis | 134/182 X |
| 4,480,387 | 11/1984 | D'Alayer de Costemore D'Arc | 134/183 X |
| 4,838,949 | 6/1989 | Dugrot | 134/182 X |

*Primary Examiner*—Philip R. Coe

*Attorney, Agent, or Firm*—Roland W. Norris; Arnold S. Weintraub

[57] ABSTRACT

A device for rinsing a razor blade head fits on to a faucet and receives tap water at line pressure. The device then channels the tap water to provide a high pressure source of directed water jets for cleaning shaving razor blades, especially of the multi-blade variety. The razor blade is inserted into a bottom cavity of the device where it is cleansed of debris by tap water channeled at high pressure through a series of conduits into the cavity. The water then exits out the body through the bottom of the cavity.

6 Claims, 1 Drawing Sheet

RAZOR BLADE RINSING DEVICE

BACKGROUND OF THE INVENTION

1. Field of the Invention:

The present invention relates generally to a device for rinsing razor blades more particularly, the present invention relates to a device for removing the debris of shaving from a razor head with blades secured therein by creating a high pressure, turbulent stream of fluid in contact with the razor head and its associated shaving blades.

2. Description of Relevant Art:

With the overwhelming commercial success of the cooperating parallel blade shaving razor; such as those exemplified sold under the trademark "TRAC-II"; there has come the problem of the small spaces surrounding the blades becoming clogged with the debris of the shaving process, such as hair and shaving soap. This clogged debris then reduces the efficiency of the blade by interfering with the shaving edges of the blades as they contact the body surface to be shaved. The debris will also hold water in the shaving head subjecting the blades to corrosion, and creating a safe haven for infectious agents which could then readily infect a shaving cut of the skin.

As the razor blades are encased within the shaving head, they may not be taken out and exposed for a thorough rinsing of shaving blades and head as with older designs of safety razors.

Mechanical implements used to physically dislodge the debris may themselves become clogged in the shaving head or, if hard enough, damage the alignment or edge of the blades.

The present invention overcomes these drawbacks by providing a device which provides high pressure fluid turbulence and directed cleaning jets lo a cavity into which the razor blade is inserted for cleaning.

No devices are known to the Applicant which provide an effective means for fluidly rinsing a fixed-blade shaving razor head. However, some cleaning devices which attach to an ordinary faucet for the rinsing of dissimilar implements are known.

Illustrative of these devices are U.S. Pat. No. 3,120,236 which discloses a cleaning device for perforated meat chopper plates. The chopping plates are mounted on an enclosed spindle while being rotated and rinsed thereon by a jet of water applied obliquely to the plates.

U.S. Pat. No. 3,577,280 discloses a hollow cylinder into which a paint roller may be inserted. Attached to the cylinder is a water conduit having through-holes which direct water obliquely on to the roller. The conduit is attachable to an ordinary water faucet. The present invention includes features which are not taught or suggested by the relevant art, to provide an effective and readily available cleaning device for the common safety shaving razor.

SUMMARY OF THE INVENTION

The present invention provides a means for cleaning razor blades and their associated blade carrying apparatus (hereinafter referred to as "razor head") of debris from the shaving process.

The present invention comprises a body having a cavity formed therein for removably receiving a razor head and, preferably, of the type wherein cooperating parallel blades are affixed therein. The present invention, also, includes means for attaching the body to a fluid source, such as a snap-on pressure fitting attachable to a water faucet or the like.

The body has a fluid conduit formed therein which extends between the fluid source attachment means and the razor-receiving cavity. This conduit may be successively narrowed to increase the initial line pressure of the fluid flowing therethrough. The present invention, also, includes an outlet formed in the body for directing fluid from the conduit to the cavity. This outlet may be suitably dimensioned to maintain the increased fluid pressure, while directing fluid onto the razor head.

In use, the present invention is attached to an ordinary source of directed fluid. To increase the working pressure of that fluid it is channeled through the successively narrowing conduits. The fluid is, then, injected via the outlet into the cavity where the razor head is placed to substantially fill the cavity. Jets of fluid are applied to the razor head through suitable openings formed in the body which define the outlet. The turbulent fluid flow resulting from the injected fluid passes over and through the razor head, cleansing any spaces therein of debris. The debris and fluid then exit the device leaving a clean and sanitary razor head.

Other attendant advantages will be more readily appreciated as the same becomes better understood by reference to the following detailed description and considered in connection with the accompanying drawings in which like reference symbols designate the parts throughout the figures.

DETAILED DESCRIPTION OF THE PREFERRED EMBODIMENT

Figure 1:
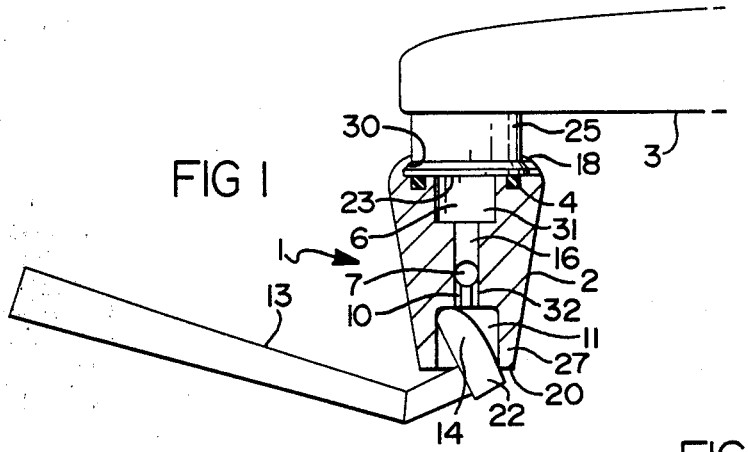
FIG. 1 is longitudinal cross-section of the razor blade rinsing device as described in the preferred embodiment and showing the environment thereof.
Figure 2:
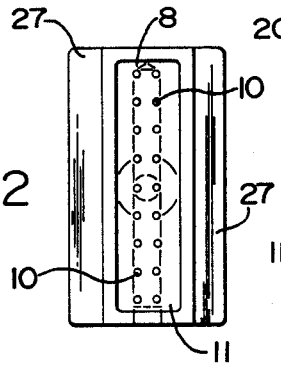
FIG. 2 is a bottom plan view hereof.
Figure 3:
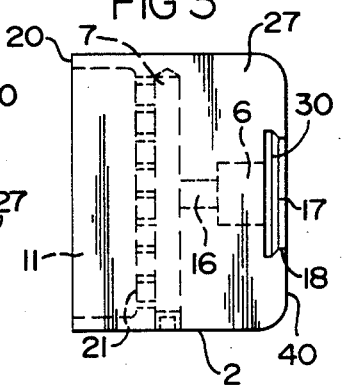
FIG. 3 is a transverse cross-section hereof.
Figure 4:
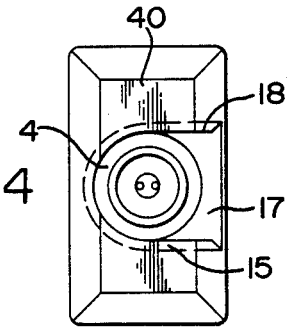
FIG. 4 is a top plan view hereof.

Now, and with reference to the drawing, the device in the illustrated form comprises a generally cube-shaped body 2 having a top wall 40 and a bottom wall 20 and four side walls 27.

It should be readily apparent to one skilled in the art that the overall external shape of the device may be varied without affecting the function thereof. The device could, for instance, be a cylinder rather than a cube.

The body 2 includes a fluid source receiving aperture 30 formed within the top wall 40 thereof. The receiving aperture 30 is in fluid communication with at least one fluid delivery conduit within the body 2, as indicated, generally, at 31. The body 2 also includes at least one fluid outlet channel 32 located between the fluid delivery conduit 31 and a razor head receiving cavity formed within the bottom wall 20 of the body 2.

Referring to FIG. 1, the fluid source receiving aperture 30 is formed in the top wall 40 of the body of the device 2; in this instance enabling the device to be attached to a suitably sized water faucet aerator 25 or the like. In the illustrated embodiment, the means for attachment comprises a clip-on fitting 15 having an open side 17 and an under cut rim 18 with an annular gasket 4 such as an 0-ring. However, any sealable faucet receptor could be provided as required for attachment to the fluid source, for example: threads, bayonet mounting etc. In the preferred embodiment the faucet aerator 26 is specially sized to fit the clip-on fitting of the device and provide a flat terminus 23 for mating with the annular gasket 4, and is supplied with the rinsing device.

It should be noted that many standard faucet fittings come with a annular ring on their lower surface which a modified version of undercut rim 18 could grasp in order to secure the lower edge of the faucet 23 to the annular gasket 4.

Alternatively, the undercut rim 18 may comprise a resilient material able to grasp a straight sided faucet fitting to sealingly thereby hold the flat terminus 23 of the aerator 25 in fluid communication with a conduit 31.

Referring, again, to the drawing, and as shown in FIG. 1, leading from the receiving aperture 30 is a conduit or bore 6 formed within the body Z which extends from the aperture 30 into the interior of the body. This bore 6 communicates at its lower end into a a second, reduced diameter bore 16. This decrease in bore diameter provides turbulence to the fluid flow passing therethrough. The second bore 16, in turn, communicates with a conduit formed within the body 2 substantially at the mid-line of the horizontal conduit 7.

Extending from the lower surface of horizontal conduit 7 is at least one row of jets or orifices 10 within the body . In the preferred embodiment, each row of small jets 8 contains a series of jets 10 extending the length of the horizontal conduit 7 at approximately equal spacing.

The jets 10 communicate at their lower ends with a cleaning cavity 11 formed within the bottom wall 20 of the body 2. The cleaning cavity 11 is, preferably, sized so as to snugly receive an ordinary safety razor head of the cooperating parallel blade type while allowing for a pivoting motion of the razor head therein.

The cleaning cavity 11 has a longitudinal axis parallel to the longitudinal axis of the conduit. The cleaning cavity 11 opens at a lower end to the outside of the body Z at bottom wall 20, thereby permitting the draining of the cavity 11.

A cutaway (not shown) communicating with the cleaning cavity may be provided in a body sidewall 27 for razor handle 13, to allow for a cleaning cavity of greater depth should such be desired to allow for cleaning of the razor head from the back portion of the razor head 22 without removal from the razor handle 13.

In use, the body 2 is attached to the faucet 3 by placing the faucet fitting open side 17 onto the faucet aerator 26 such that the undercut rim 12 will securely grasp the faucet aerator and place the faucet aerator lower edge 23 in sealing contact with annular gasket 4. Razor head 14 is then placed in cleaning cavity 11 substantially filling the cavity. The preferred embodiment is configured to allow razor handle 13 to rest against the lower wall 20 of the body 2 when the razor is in the proper position to be cleaned. This position places the open space beneath each parallel blade facing substantially towards, and in alignment with, a row of small jets 8.

Water is then turned on through the faucet 3. The line pressure of the water is increased and a turbulent flow induced by the channeling of the water through the successively narrow conduits until it emerges from the rows of small jets 8 in high pressure streams to contact the debris impacted in the spaces of the razor head. As there may be different spacings and voids in the razor head as among the various commercial blades, the razor is then pivoted through the cleaning cavity several times to ensure that a turbulent fluid flow contacts as much of the razor face 29 as possible. A direct fluid stream to the debris impacted spaces is not necessary for a thorough cleaning due to the fluid turbulence within the cavity. The debris is carried out the back of the razor head by turbulent water flow and thereafter out the bottom of the cleaning cavity 11 to drain the device 1.

It is apparent, although not illustrated, that different routing or sizing of the conduit structure is possible herein, such as, for example, a single spiraling conduit of continually narrowing diameter which might end in one narrow elongated orifice in communication with the cavity. Another alternative would include placing the device unobtrusively on or within the razor itself such as by using a hollow razor handle as the fluid conduit and forming a cleaning cavity integral with the razor head.

From the foregoing it can be seen that the present invention has been illustrated and described in connection with the preferred embodiments, but is not to be limited to the particular structure shown, because many variations thereof will be evident to one skilled in the art and are intended to be encompassed in the present invention as set forth in the following claims.

Having, thus, described the invention, what is claimed is

1. A body with a cavity formed therein for removably receiving a razor head, comprising:

a) at least two side walls;

b) means for sealing attachment of the body to a directed fluid source;

1) the means for attachment being formed within the body, 2) the means for attachment having:

i) a semi-circular side surface open to at least one body side wall;

ii) a bottom surface;

iii) the semicircular surface and the bottom surface forming a receiving aperture for receiving the fluid source;

iv) the means for attachment having an annular gasket on the bottom surface to opposingly mate with and seal a terminus of the fluid source;

c) a first conduit formed within the body in fluid communication with the receiving aperture the first conduit having a receiving end and a discharge end, the receiving end having a diameter larger than that of the discharge end;

d) a second conduit formed within the body in fluid communication with the discharge end of the first conduit, the second conduit having at least one fluid outlet;

e) the cavity formed within the body being sized for receiving a razor blade, the cavity being in fluid communication with the outlet of the second conduit and an exterior surface of the body.

2. The body according to claim 1, wherein:

the outlet comprises a plurality of jets having a diameter smaller than the diameter of the second conduit.

3. The body according to claim 2 wherein:

the jets are arranged in parallel rows.

4. A device for removably receiving a razor head, comprising:

a) a body, the body having:

1) at least one side wall, (2) means for releasable sealing attachment of the body to a directed fluid source, the means for attachment having:

i) at least two side surfaces, ii) a bottom surface, iii) the side surfaces and the bottom surface forming a receiving aperture for receiving the fluid source, iv) the side surfaces being open to at least one body side wall, v) the side surfaces having undercut rims thereon for frictionally engaging the fluid source, vi) the bottom surface having an annular gasket therein for opposingly mating with and sealing the terminus of the fluid source;

b) a conduit formed within the body and in fluid communication with the receiving aperture;

c) a cavity formed by the body located in fluid connection with the conduit, the cavity being sized to receive a razor blade; and, d) means for draining the cavity.

5. A device for rinsing razor blades, comprising:

a body;

a fluid delivery conduit;

the fluid delivery conduit having a nozzle forming an annular flange with a flat terminus;

means for attaching the body to the fluid delivery conduit, the means for attaching being formed within the body, the means for attaching having a semi-circular side surface and a bottom surface, the semicircular surface and the bottom surface forming a mating void for the nozzle, the means for attaching comprising an annular gasket on the bottom surface to opposingly mate with and seal the flat terminus of the nozzle;

a conduit within the body in fluid communication with the means for at!aching;

a cavity formed in the body f or receiving a razor blade, the cavity being in fluid communication with the conduit and means for draining the cavity.

6. The body according to claim 1, wherein:

the semicircular side surface of the means for attachment has an undercut rim thereon for frictionally engaging the fluid source.

* * * * *